US007626568B2

(12) United States Patent
Hsu et al.

(10) Patent No.: US 7,626,568 B2
(45) Date of Patent: Dec. 1, 2009

(54) GATE SWITCH APPARATUS FOR AMORPHOUS SILICON LCD

(75) Inventors: Chih-Hsin Hsu, Hsinchu (TW); Ching-Wu Tseng, Taipei County (TW)

(73) Assignee: Novatek Microelectronics Corp., Hsinchu (TW)

( * ) Notice: Subject to any disclaimer, the term of this patent is extended or adjusted under 35 U.S.C. 154(b) by 554 days.

(21) Appl. No.: 11/163,090

(22) Filed: Oct. 4, 2005

(65) Prior Publication Data

US 2006/0267909 A1 Nov. 30, 2006

(30) Foreign Application Priority Data

May 25, 2005 (TW) ..... 94117014 A

(51) Int. Cl.
*G09G 3/36* (2006.01)

(52) U.S. Cl. ..... 345/98; 345/103; 345/205

(58) Field of Classification Search ..... 345/83–103, 345/205

See application file for complete search history.

(56) References Cited

U.S. PATENT DOCUMENTS

| | | | | |
|---|---|---|---|---|
| 6,011,531 | A * | 1/2000 | Mei et al. | 345/92 |
| 6,542,144 | B2 * | 4/2003 | Kogure et al. | 345/98 |
| 2002/0080108 | A1 * | 6/2002 | Wang | 345/90 |

FOREIGN PATENT DOCUMENTS

| | | |
|---|---|---|
| JP | S61-126595 | 6/1986 |
| JP | 2002-215119 | 7/2002 |

OTHER PUBLICATIONS

"Office Action of Japan counterpart application", issued on May 8, 2009, p. 1-p. 3.

* cited by examiner

*Primary Examiner*—Amare Mengistu
*Assistant Examiner*—Hong Zhou
(74) *Attorney, Agent, or Firm*—Jianq Chyun IP Office

(57) ABSTRACT

A gate switch apparatus of a-Si LCDs is provided. The gate switch apparatus is suitable for switching a plurality of sub gate lines and disposed in two rim spaces of a display to make a-Si TFT switch with less impedance. According to a switch driving timing, a plurality of sub gate lines are able to share a single gate line, which saves cost and reduces the difficulty in the manufacturing process.

19 Claims, 7 Drawing Sheets

GATE SWITCH APPARATUS FOR AMORPHOUS SILICON LCD

CROSS-REFERENCE TO RELATED APPLICATION

This application claims the priority benefit of Taiwan application serial no. 9411 7014, filed on May 25, 2005. All disclosure of the Taiwan application is incorporated herein by reference.

BACKGROUND OF THE INVENTION

1. Field of Invention

The present invention relates to a gate switch apparatus of a LCD, and particularly to a gate switch apparatus of an amorphous silicon LCD (a-Si LCD).

2. Description of the Related Art

A LCD is a display designed according to the liquid crystal principle and liquid crystal mechanism. Normally, liquid crystal can free flow like liquid. However, the molecules in liquid crystal are arranged in a certain pattern, so the optic characteristic thereof is unstable and easily affected by outside conditions, such as electric field, temperature and pressure. The variation of the outside conditions would cause optoelectronic effects with the liquid crystal. LCDs are categorized in two driving modes, a simple-matrix mode and an active-matrix mode, wherein LCDs in active-matrix mode can be a tri-terminal structure such as the typical products of MOSFET-LCD (metal oxide semiconductor field effect transistor LCD) and TFT-LCD (thin film transistor LCD). Among all LCDs in the active-matrix mode, the TFT-LCD has the most potential. In the TFT-LCD field, there are two widely developed technologies, the amorphous silicon TFT (a-Si TFT) and the low-temperature polysilicon TFT (LTPS TFT).

In fact, TFT-LCDs have wide applications, such as calculators, watches, game devices, regular electric appliances, portable electronic dictionaries, word processors, notebook PC, workstations and flat-panel plasma TV.

However, in designing a high-resolution TFT-LCD in the prior art, the number of channels required in the driver thereof is higher, which leads an increased production cost. In addition, an increasing junction points in the driver of a high-resolution TFT-LCD raises the difficulty of assembly in the manufacturing process.

To solve the above-described problems, in a conventional driving system of LTPS TFT, TFTs are used as switches because the electrons move fast enough. The source driver herein is designed as a common source output signal with a switching function, so that each output channel for driving the IC is able to drive a plurality of LCD data lines at different time segment. Thus, the required channel of a source driver is reduced, which accordingly reduces the production cost.

Referring to FIG. 5, a schematic active-matrix circuit drawing of a conventional LTPS LCD is shown, wherein a gate driver 500 is at the left side and a source driver 510 is at the bottom. The gate driver 500 provides an addressing signal, which coordinates with a timing control to turn on or off the TFT gate in sequence and further control the turning on/off of TFTs. Thus, a gray-level data voltage provided by the source driver 510 can charge the storage capacitors such that the gray-level data voltage stored in the storage capacitors are is saved. Further, the gray-level data voltage of the storage capacitor is transferred or read, to become the voltage value of the LCD device. Accordingly, a displaying process of a pixel unit (including a TFT, a storage capacitor and a LCD device) is then completed.

Based on the excellent conductive characteristic of a polysilicon TFT, a LTPS LCD utilizes the common output channels of the source driver 510 for reducing the number of the original source output channels by two thirds; i.e. only one third of the original source output channels remains.

On the other hand, in an a-Si TFT-LCD, since the impedance of an a-Si TFT tends to be very large when an a-Si TFT is on, the TFT width therefore must be widened to reduce the impedance thereof. As a result, the size of the transistor must be increased, and the number of pixel units may be accordingly reduced. For a high-resolution a-Si LCD, such design is seriously flawed. Therefore, the conventional design does not fit to serve as a switch, and further complicates the design and mass production process.

SUMMARY OF THE INVENTION

An object of the present invention is to provide a gate switch apparatus of LCDs for switching among a plurality of sub gate lines through one gate line, and for a plurality of sub gate lines to share a gate line according to a driving sequence.

Another object of the present invention is to provide a gate switch apparatus of a-Si LCDs for switching among a plurality of sub gate lines though a gate line, and a-Si TFT switch with less impedance at two rims of the margins of a LCD, such that a plurality of sub gate lines can share a gate line according to a driving sequence.

The present invention provides a gate switch apparatus of a LCD suitable for switching a plurality of sub gate lines through a single gate line. The gate switch apparatus includes a plurality of first switches and a plurality of second switches. Wherein, each of the first switches includes a first end and a second end for receiving a switch signal. The first end of each first switch is coupled to a gate line; the second end of each first switch is coupled to a corresponding sub gate line; the first end and the second end are turned on/off according to the switch signal. Moreover, each of the second switches includes a third end and a fourth end for receiving an inverting switch signal. The third end of each second switch is coupled to the second end of the corresponding first switch; the fourth end of each second switch is coupled to a first voltage level; the third end and the fourth end are turned on/off according to the inverting switch signal.

In the gate switch apparatus of the embodiments, the above-mentioned first switch and second switch are TFTs.

According to the embodiments of the present invention, the above-mentioned first switch and second switch in the gate switch apparatus are disposed at two rims of the surrounding margins of a LCD.

According to the embodiments of the present invention, the above-mentioned gate line in the gate switch apparatus provides a gate signal, and the required conducting time of the gate signal is larger than the conducting time of the switch signals.

According to the embodiments of the present invention, the above-mentioned switch signal in the gate switch apparatus is a time-division conductive signal; i.e. when one of the switch signals is on, the other switch signals are off.

According to the embodiments of the present invention, in the gate switch apparatus, between one switch signal is turned on and the next switch signal is turned on is a time interval.

According to the embodiments of the present invention, the above-mentioned first switch and second switch in the gate switch apparatus are a-Si TFTs.

According to the embodiments of the present invention, in the gate switch apparatus, the above-mentioned first voltage level is a low voltage level.

The present invention provides a gate switch apparatus of an a-Si LCD suitable for LCD gate drivers and switching a plurality of sub gate lines through a single gate line. Two margins enclosing the display area in a LCD is referred to as two rims. The gate switch apparatus of an a-Si LCD of the present invention is characterized in that the gate switch apparatus includes a plurality of a-Si TFT switches; each a-Si TFT switch includes a first end and a second end which receives a switch signal; the first end of each a-Si TFT switch is coupled to the gate line; the first end and the second end are turned on/off according to the switch signal; and the space of the two rims are used for disposing a plurality of a-Si TFT switches.

According to the embodiments of the present invention, in the gate switch apparatus of the a-Si LCD, the above-mentioned gate line provides a gate signal for producing a plurality of square-wave signals corresponding to a number of a-Si TFT switches.

According to the embodiments of the present invention, in the gate switch apparatus of the a-Si LCD, the above-mentioned switch signals are time-division conductive signals; i.e. when one of the switch signals is on, the other switch signals are off.

According to the embodiments of the present invention, in the gate switch apparatus of the a-Si LCD, the above-mentioned the switch signals have a conducting time. Only after the corresponded gate signal takes a turning-on voltage level, one of the switch signals takes a turning-on voltage level; only after the last switch signal among the plurality of the switch signals takes a turning-off voltage level, the gate signal takes a turning-off voltage level. The produced sub gate line signal is an overlapping point of the corresponding gate signal and the switch signal.

From the above described in the present invention, it can be seen that a gate switch apparatus is utilized in an a-Si LCD so that the output gate line number of a driver is reduced; the two rims provides a space for accommodating the a-Si TFT switches of the gate switch apparatus with less impedance; further, a time-division driving sequence for driving the IC is provided to switch the LCD gate switch apparatus. Accordingly, a plurality of sub gate lines can be switched through one gate line, which can save the cost and reduces production difficulty.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve for explaining the principles of the invention.

DESCRIPTION OF THE EMBODIMENTS

In the embodiments of the present invention, the gate switch apparatus of an a-Si LCD is disposed in two rims, which enclose the LCD display area and have a bigger space available for accommodating the gate switch apparatus. By means of switch signal control, a gate signal provided by a gate driver is divided into several timings, so that a plurality of sub gate line signals can share a single gate line for outputting signals. The area for disposing the gate switch apparatus is not limited to the above-described rims. In fact, any non-display space in a LCD can be used for accommodating the gate switch apparatus.

Figure 1:
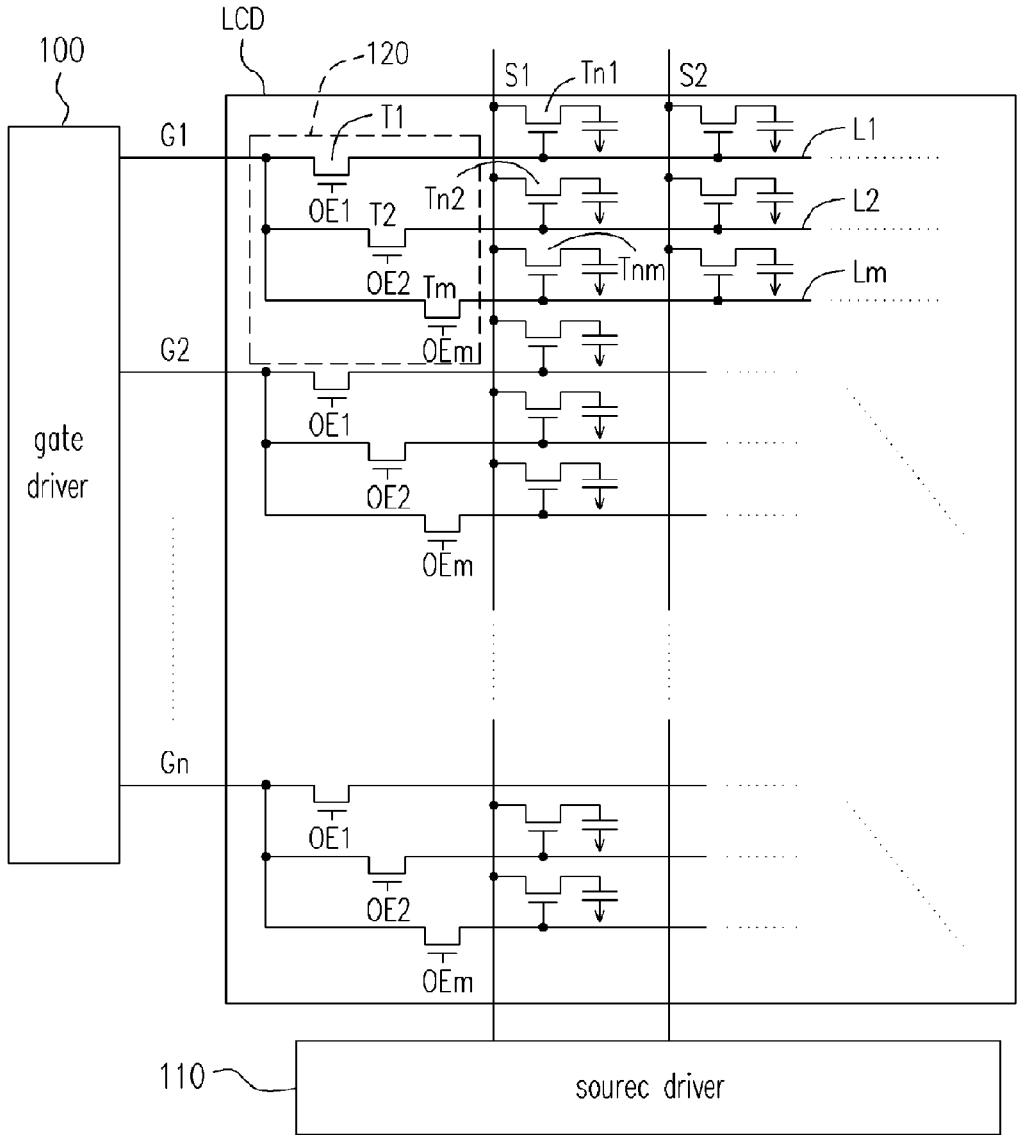
FIG. 1 is a schematic active-matrix circuit drawing of an amorphous LCD, wherein the dotted-line frame indicates a gate switch apparatus according to an embodiment of the present invention.

Referring to FIG. 1, a schematic active-matrix circuit drawing of an amorphous LCD is shown, wherein the dotted-line frame indicates a gate switch apparatus 120 according to an embodiment of the present invention. A single output channel Gi (i=1~n) of a gate driver 100 is able to drive m pieces of sub gate lines. The switch signals (OE1, OE2, . . . , OEm) provided by a control line switch a plurality of A-Si TFT switches (T1, T2, . . . , Tm), respectively. Further, the A-Si TFT switches drive a first sub gate line L1, a second sub gate line L2, . . . , a m-th sub gate line Lm. Since an a-Si TFT (Tn1, Tn2, . . . , Tm) is generally disposed within a pixel unit with a restricted space, the a-Si TFT is accordingly made in a small size, which has high impedance when turned on. As a result, an impedance of several million Ohms prevents an a-Si TFT from effectively switching because a switch herein must be capable of driving the load of a whole gate.

In the embodiments of the present invention, a-Si TFTs (for example, Tn1, Tn2, . . . , Tm) are disposed in two rims of a LCD where a plenty space is suitable for making the a-Si TFTs with a ratio of width over length (W/L) required by low impedance, such that power consumption can be reduced when making the switch.

Figure 2:
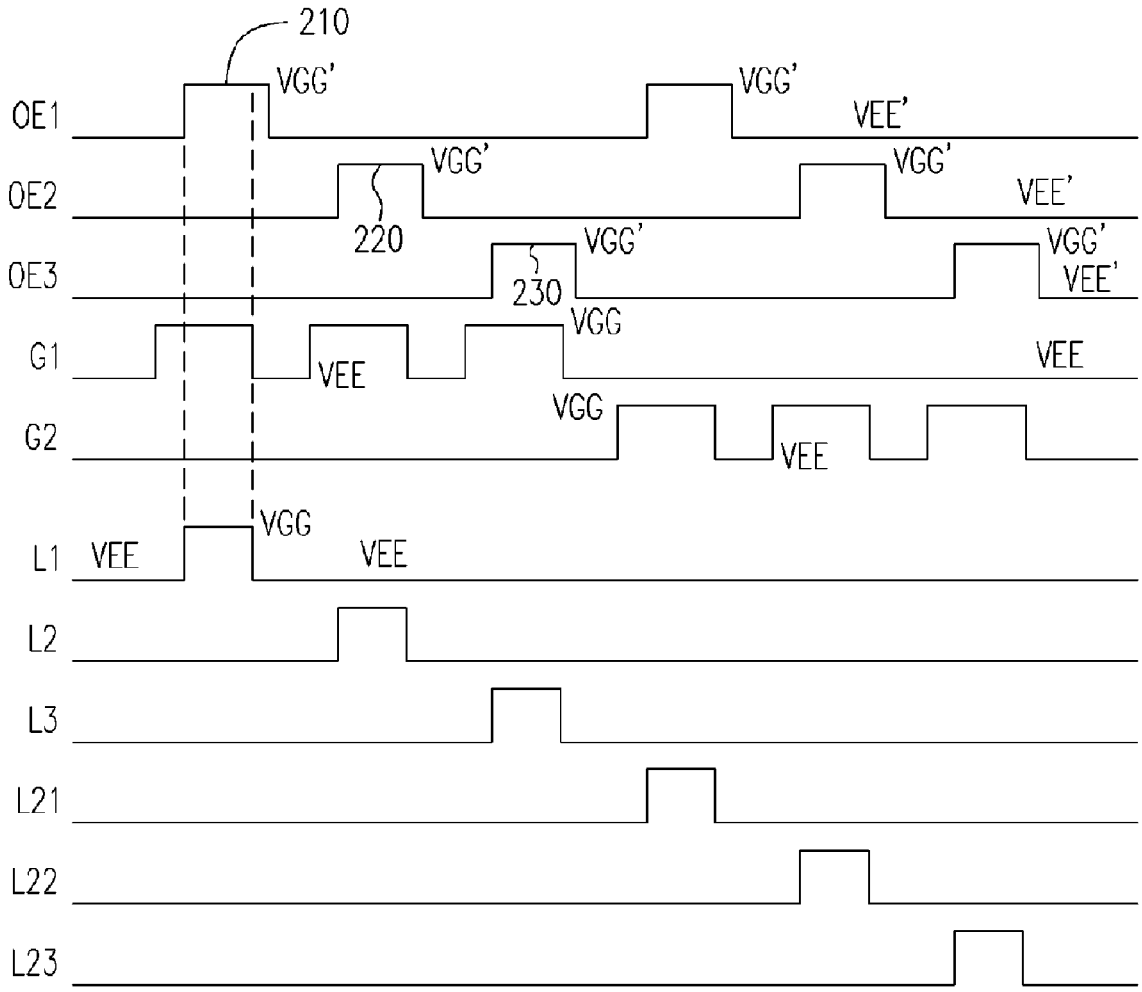
FIG. 2 is a schematic timing chart for driving the gate switch apparatus of an amorphous LCD according to an embodiment of the present invention.

The operation is explained in details as follows. Referring to FIGS. 1 and 2, FIG. 2 is a schematic timing chart for driving the gate switch apparatus of an amorphous LCD according to an embodiment of the present invention. In FIG. 1, a switch signal OE1 turns on the a-Si TFT T1, therefore the sub gate line L1 is driven by the output signal of the gate line G1 from the gate driver 100 and the first column of a-Si TFTs (for example, Tn1) charges a storage capacitor. After a preset conducting time, the gate line G1 changes into a low level. Therefore, the voltage of the sub gate line L1 is accordingly pulled down to a low level, thus closing the a-Si TFT T1 and blocking the data. Afterwards, a switch signal OE2 turns on the a-Si TFT T2, therefore the sub gate line L2 is driven by the output signal of the gate line G1 from the gate driver 100 (G1 is at a high level). Then, the above-described operation is repeated, wherein the first column of the a-Si TFTs (for example, Tn2) charges a storage capacitor and the data are blocked. In the end, a switch signal OEm turns on the a-Si TFT Tm switch, therefore the sub gate line Lm is driven by the output signal of the gate line G1 from the gate driver 100 and the pixel unit is accordingly charged.

FIG. 2 is a schematic timing chart for driving the gate switch apparatus of an amorphous LCD according to an embodiment of the present invention. Wherein, OE1, OE2 and OE3 indicate switch signals, G1, G2 and G3 indicate gate lines and the signals thereof, and L1, L2, L3, L21, L22 and L23 indicate sub gate lines and the signals thereof. The sub gate lines L1-L3 and L21-L23 are controlled by the switch signals and to output the constant voltage VGG (high-level) sequentially to drive the gate. After the pixel units are charged, the sub gate lines restore back to VEE (low-level) and gray-level voltages in the pixel units are maintained. After the gate line G1 is driven, the switch signal OE1 starts to be pulled up to VGG' (the constant voltage VGG is normally higher than VGG). As the gate line G1 is turned off, the signal of the sub gate line L1 is also pulled down to VEE (low level), then the switch signal OE1 is pulled down to VEE' (a low level voltage along when the switch is turned off). By the above-described timing, faulty operations in the a-Si TFTs of the pixel units can be prevented.

The gate line G1 can produce three successive square-waves as a set. The three square-waves of the set corresponds to a square-wave 210 of the switch signal OE1, a square-wave 220 of the switch signal OE2 and a square-wave 230 of the switch signal OE3, respectively. The switch signals OE1, OE2 and OE3 are time-division signals, and only one switch signal is turned on at a time. The switch signals have a conducting time. For example, only after the gate line signal G1 takes a turning-on voltage level, the switch signals OE1 takes a turning-on voltage level; only after the gate line signal G1 takes a turning-off voltage level, the switch signals OE1 takes a turning-on voltage level. The produced sub gate line signal L1 is an overlapping point of the gate line signal G1 and the switch signal OE1.

Figure 3:
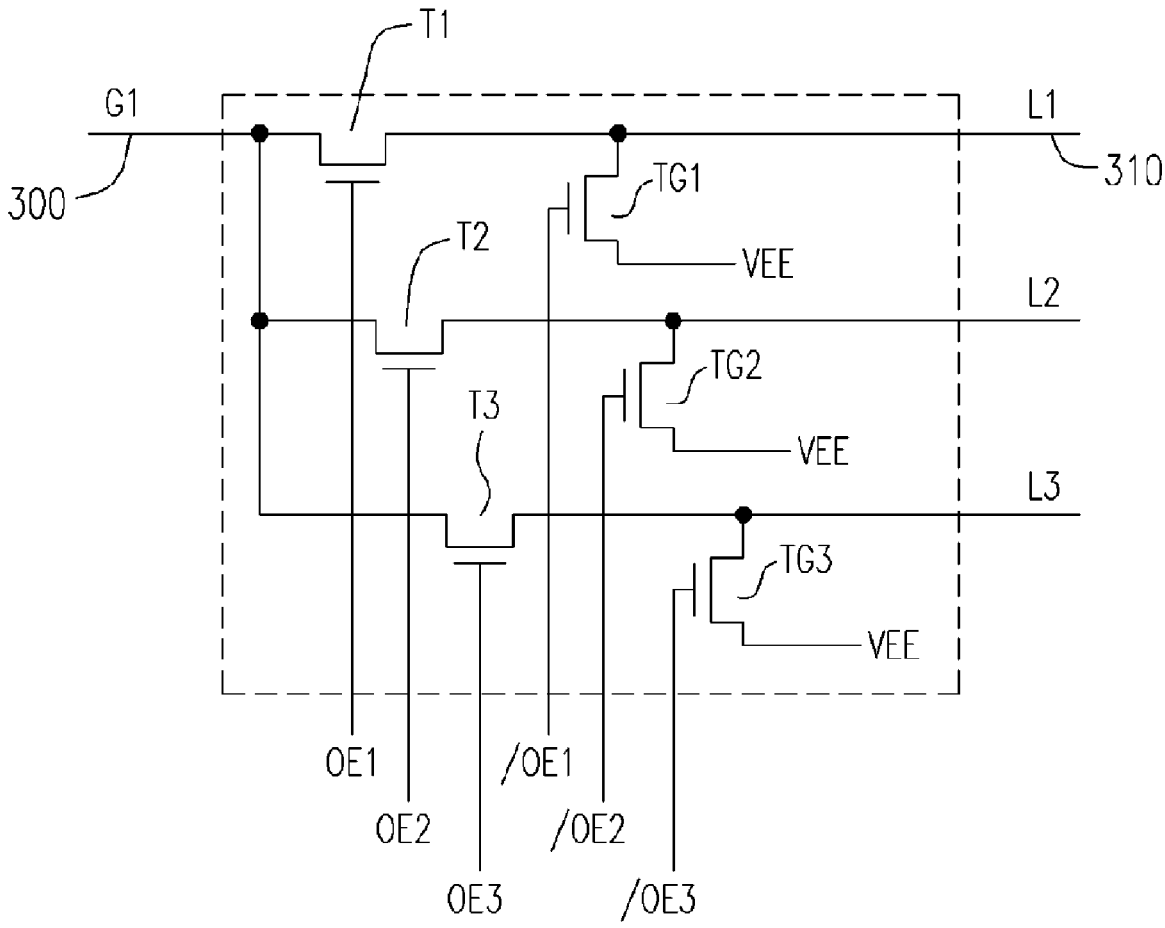
FIG. 3 is a schematic circuit drawing of a gate switch apparatus of a LCD according to another embodiment of the present invention.

Another embodiment of the present invention is to modify the gate switch apparatus 120 indicated by a dotted-line frame in FIG. 1 into a design shown in FIG. 3. Referring to FIG. 3, except for the a-Si TFTs T1, T2 and T3, another set of a-Si TFTs, TG1, TG2 and TG3 are added. Besides, OE1, OE2 and OE3 are provided with inverting signals (/OE1, /OE2 and /OE3). When /OE1, /OE2 and /OE3 are at high levels, i.e. the switch signals OE1, OE2 and OE3 are active, the sub gate lines L1, L2 and L3 are pulled down to the low levels by turning on the a-Si TFTs TG1, TG2 and TG3, respectively. Accordingly, the a-Si TFTs (for example, Tn1) in the pixel units connected to the gate switch apparatus 120 can be closed.

Figure 4:
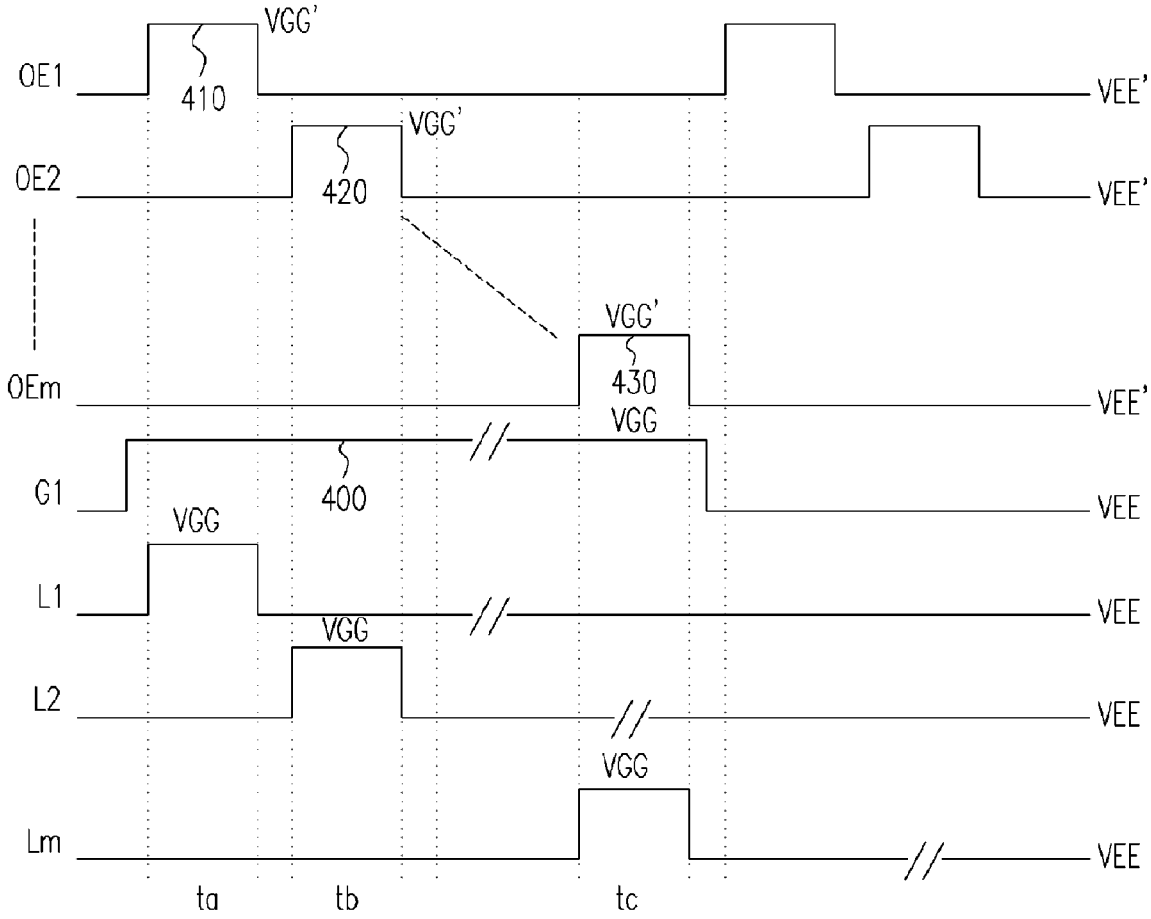
FIG. 4 is a schematic timing chart for driving the gate switch apparatus of an amorphous LCD according to another embodiment of the present invention.
Figure 5:
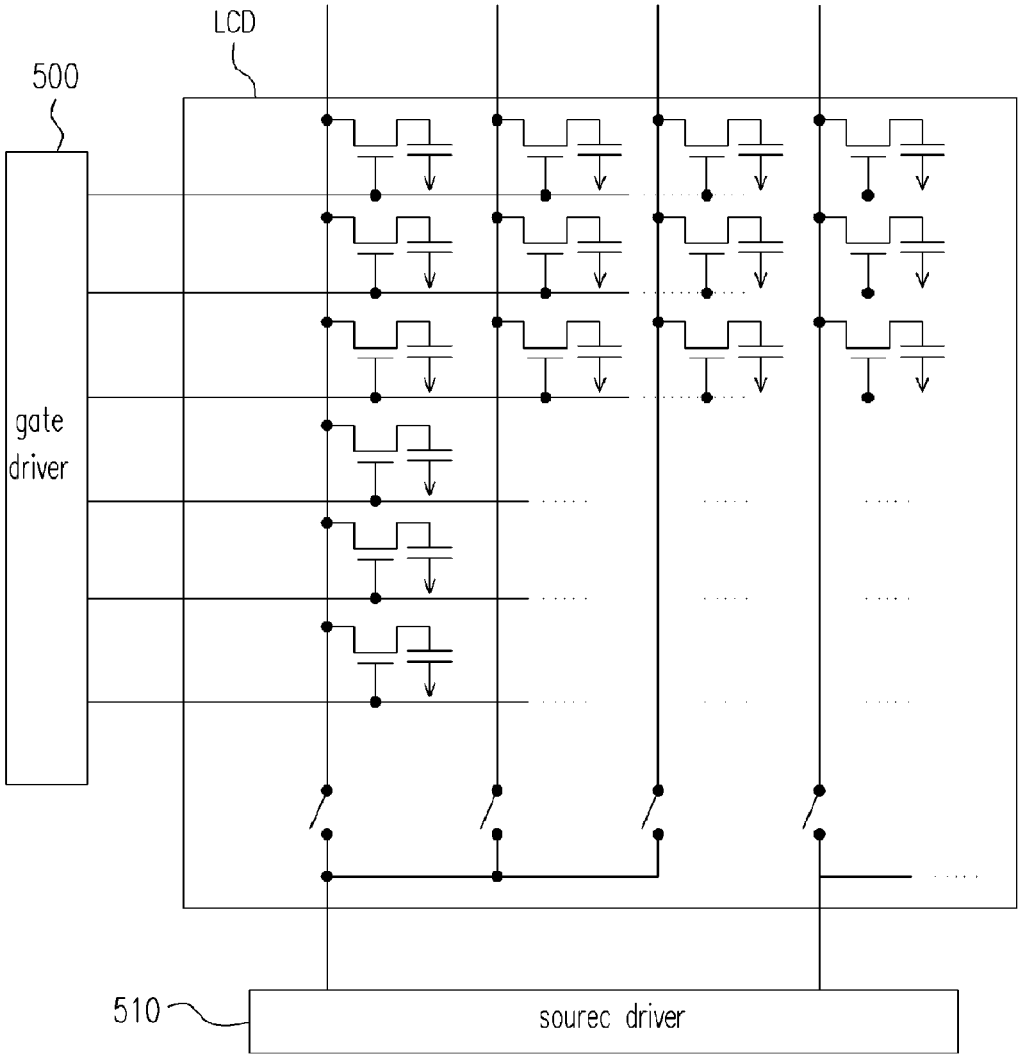
FIG. 5 (PRIOR ART)
FIG. 5 is a schematic active-matrix circuit drawing of a conventional low-temperature poly silicon LCD.

Referring to FIG. 4, it is a schematic timing chart for driving the gate switch apparatus of an amorphous LCD according to another embodiment of the present invention. After the gate line G1 (or G2) signal outputs a positive high voltage VGG, the switch signals OE1-OEm turn on the switches to VGG' level in sequence (VGG' is normally higher than VGG). Thus, the sub gate lines L1-Lm output the positive high-level VGG in sequence during the timing ta, tb and tc, respectively such that the gray-level voltages output from the source are written into the pixel units. On the contrary, for the other time, the switch signals OE1-OEm outputs a VEE' low level in sequence (VEE' is a lower-level for turning off the switches). Thus, the a-Si TFTs TG1-TGm are turned on and the sub gate line signals L1-Lm are pulled down to a low-level (a negative VEE). At this time, the gray-level voltages of the pixel units are maintained and the horizontal lines can be completely scanned.

Note that the conducting time 400 of the gate line G1 must be longer than the conducting time of the switch signals OE1, OE2, . . . , OEm (i.e. 410, 420, . . . , 430). In other words, when the gate line G1 is turned on, the other switch signals OE1, OE2, . . . , OEm must be switched within the time segment. Moreover, the switch signals OE1-OEm are time-division signals; i.e. as the switch signal OE1 is turned on, the other switch signals OE2 to OEm are turned off. In addition, between the conducting time of the switch signals OE1 (square wave 410) and the conducting time of the switch signals OE2 (square wave 420) and between the conducting time of the switch signals OE2 (square wave 420) and the conducting time of the switch signals OE3 (square wave 430) is an interval, respectively. Therefore, only one sub gate line is allowed to be turned on at a time.

Figure 6:
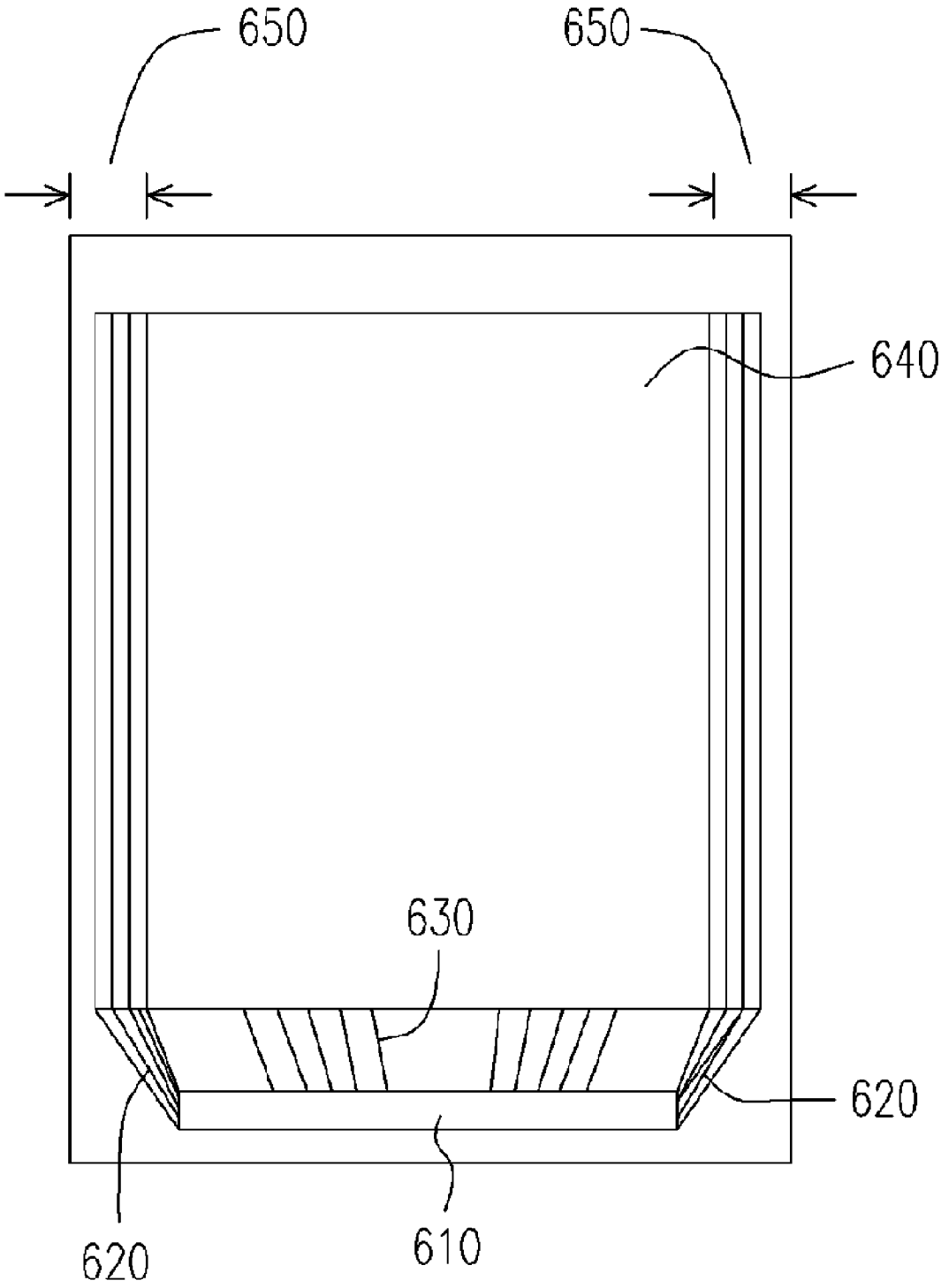
FIG. 6 illustrates a driving system employed in a regular mobile phone LCD today.

FIG. 6 illustrates a driving system employed in a regular mobile phone. Referring to FIG. 6, source lines 630 and gate lines 620 are output from a single-chip driver 610. Wherein, the gate lines 620 are laid out in both sides of the glass panel for delivering the gate signals to control points. The more the gate lines 620, the more space in the rims 650 are required, which leads to extra cost. In the gate switch apparatus of the present invention with a resolution of, for example, 176 RGB×240 (with 240 gate lines) however, if three sub gate lines share one gate line, 157 gate lines are saved (240−240/3−3=157). Consequently, the gate line number of a driver IC and the cost required by the wires and wiring area are reduced. Along with a reduced number of driving lines, the difficulty for assembly in the manufacturing processing is further reduced, the yield is advanced and the production cost is further saved.

Figure 7:
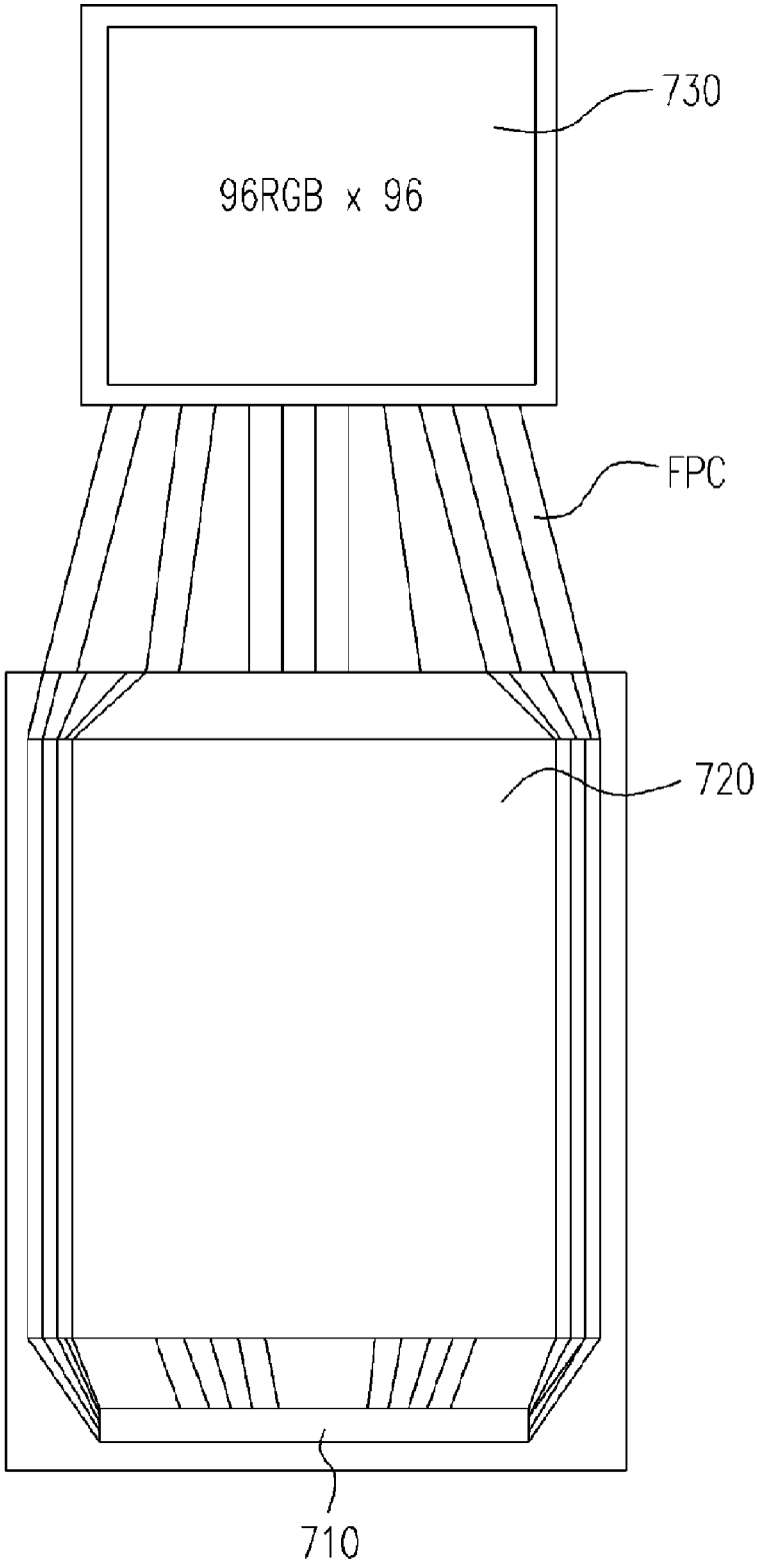
FIG. 7 illustrates electric connection wires for a dual-panel mobile phone.

FIG. 7 illustrates electric connection wires for a dual-panel mobile phone. Referring to FIG. 7, for a back panel with a resolution of 96 RGB×96, in a conventional LCD, 384 pieces of wires are needed (96×3+96=384). The 384 pieces of wires are connected to the back panel 730 via a flexible printed circuit (FPC). The FPC of a mobile phone has a limited size, which is hard for accommodating so many wires. Therefore, in such application, it is hard in an assembly process. While in the same application using the presently invented gate switch apparatus, if three sub gate lines share one gate line, the number of the gate lines disposed on the FPC would be reduced to 323 pieces (96×3+96/3+3=323). Consequently, the space between two adjacent channels on the FPC is widened and the assembly process between the FPC and the back panel is easier.

In the gate switch apparatus of the embodiment of the present invention, the employed transistors are, but not limited to, a-Si TFTs. Any other appropriate TFT can be used herein, for example, low-temperature poly silicon TFTs (LTPS TFTs).

In summary, the gate switch apparatus of a a-Si LCD in the embodiment of the present invention is characterized in that an extra set of a-Si TFTs are equipped in a conventional a-Si LCD to form gate switch apparatuses disposed in the rims or the other available space. In addition, a set of simple switch signals are provided, so that a gate line can be shared and the required number of the gate channels from the driver is reduced, thus saving cost.

It will be apparent to those skilled in the art that various modifications and variations can be made to the structure of the present invention without departing from the scope or spirit of the invention. In view of the foregoing, it is intended that the specification and examples to be considered as exemplary only, with a true scope and spirit of the invention being indicated by the following claims and their equivalents.

What is claimed is:

1. A gate switch apparatus of a LCD, suitable for a gate line to switch a plurality of sub gate lines, the gate switch apparatus comprising:

a plurality of first switches, wherein each of the first switches comprises a first end and a second end for receiving a switch signal, the first end of each first switch is coupled to the gate line, the second end of each first switch is coupled one-on-one to the corresponding sub gate lines, and the switch signals turn on or off the electric connection between the first end and the second end; and a plurality of second switches, wherein each of the second switches comprises a third end and a fourth end for receiving an inverting switch signal, the third end of each second switch is coupled one-on-one to the corresponding second end of the first switch, the fourth end of each second switch is coupled to a first voltage level, and the inverting switch signal turns on or off the electric connection between the third end and the fourth end;

wherein the gate line provides a gate signal, and a period that the gate signal is driven is longer than a summation of periods that the switch signals are asserted, and the first switches are conducted when the switch signals are asserted and the gate signal is driven.

2. The gate switch apparatus of a LCD as recited in claim 1, wherein the first switch and second switch are a TFT, respectively.

3. The gate switch apparatus of a LCD as recited in claim 2, wherein the first switches and second switches are disposed in two rims within the surrounding margins of a display panel.

4. The gate switch apparatus of a LCD as recited in claim 2, wherein the first switch and second switch are a-Si TFTs.

5. The gate switch apparatus of a LCD as recited in claim 1, wherein the switch signals are time-division conductive signals, and when only one of the switch signals is turned on, all other switch signals are turned off.

6. The gate switch apparatus of a LCD as recited in claim 5, wherein between the time each switch signal is turned on and next switch signal is turned on is an interval.

7. The gate switch apparatus of a LCD as recited in claim 1, wherein the first voltage level is a low level.

8. A gate switch apparatus of an a-Si LCD, suitable for LCD gate drivers and a single gate line to switch a plurality of continuous sub gate lines, wherein two columns of margins enclosing the display area in a LCD is referred to as two rims; the gate switch apparatus is characterized in: comprising a plurality of a-Si TFT switches, wherein each a-Si TFT switch includes a first end and a second end for receiving a switch signal; the first end of each a-Si TFT switch is coupled to the gate line; the switch signal turns on or off the first end and the second end; the space of the two rims are used for accommodating a plurality of the a-Si TFT switches.

9. The gate switch apparatus of an a-Si LCD as recited in claim 8, wherein the gate line provides a gate signal for producing a plurality of square-wave signals and the number of the square-wave signals corresponds to the number of a-Si TFT switches.

10. The gate switch apparatus of an a-Si LCD as recited in claim 8, wherein the switch signals are time-division conductive signals, and when only one of the switch signals is turned on, all other switch signals are turned off.

11. The gate switch apparatus of an a-Si LCD as recited in claim 10, wherein the turning on sequence of each switch signal is such that only after the corresponded gate signal takes a turning-on voltage level, one of the switch signals takes a turning-on voltage level; only after the last switch signal among the plurality of the switch signals takes a turning-off voltage level, the gate signal takes a turning-off voltage level, and the produced sub gate line signal is an intersection of the corresponded gate signal and the switch signal in terms of time domain.

12. A gate switch apparatus of a LCD, suitable for a gate line to switch a plurality of continuous sub gate lines, the gate switch apparatus comprising:

a plurality of first switches, wherein each of the first switches comprises a first end and a second end for receiving a switch signal, the first end of each first switch is coupled to the gate line, the second end of each first switch is coupled one-on-one to the corresponding continuous sub gate lines, and the switch signals turn on or off the electric connection between the first end and the second end; and a plurality of second switches, wherein each of the second switches comprises a third end and a fourth end for receiving an inverting switch signal, the third end of each second switch is coupled one-on-one to the corresponding second end of the first switch, the fourth end of each second switch is coupled to a first voltage level, and the inverting switch signal turns on or off the electric connection between the third end and the fourth end.

13. The gate switch apparatus of a LCD as recited in claim 12, wherein the first switch and second switch are a TFT, respectively.

14. The gate switch apparatus of a LCD as recited in claim 13, wherein the first switches and second switches are disposed in two rims within the surrounding margins of a display panel.

15. The gate switch apparatus of a LCD as recited in claim 13, wherein the first switch and second switch are a-Si TFTs.

16. The gate switch apparatus of a LCD as recited in claim 12, wherein the gate line provides a gate signal, and a period that the gate signal is driven is longer than a summation of periods that the switch signals are asserted, and the first switches are conducted when the switch signals are asserted and the gate signal is driven.

17. The gate switch apparatus of a LCD as recited in claim 16, wherein the switch signals are time-division conductive signals, and when only one of the switch signals is turned on, all other switch signals are turned off

18. The gate switch apparatus of a LCD as recited in claim 17, wherein between the time each switch signal is turned on and next switch signal is turned on is an interval.

19. The gate switch apparatus of a LCD as recited in claim 12, wherein the first voltage level is a low level.

* * * * *